US005794372A

United States Patent [19]

Grana

[11] Patent Number: 5,794,372

[45] Date of Patent: Aug. 18, 1998

[54] PICTURE FRAME MOLDING

[76] Inventor: Gary G. Grana, 213 S. Arlington Heights Rd., Arlington Heights, Ill. 60005

[21] Appl. No.: 899,596

[22] Filed: Jul. 24, 1997

Related U.S. Application Data

[63] Continuation of Ser. No. 539,751, Oct. 5, 1995, abandoned.

[51] Int. Cl.[6] ..... G09F 1/12

[52] U.S. Cl. ..... 40/729; 40/780; 40/605

[58] Field of Search ..... 40/605, 729, 730, 40/743, 780, 732; 52/204.62, 204.63, 204.7, 204.705, 282.2, 656.5, 656.7, 720.1, 734.1, 734.2

[56] References Cited

U.S. PATENT DOCUMENTS

| | | | |
|---|---|---|---|
| 312,005 | 2/1885 | Naughton . | |
| 935,704 | 10/1909 | Stoddard | 40/729 |
| 945,576 | 1/1910 | McPherson . | |
| 1,341,971 | 6/1920 | Chrobak . | |
| 1,692,999 | 11/1928 | Siegel . | |
| 2,392,551 | 1/1946 | Roe | 52/586.2 |
| 2,601,734 | 7/1952 | Couzinet . | |
| 2,657,488 | 11/1953 | Knox . | |
| 2,735,205 | 2/1956 | Knox . | |
| 3,370,389 | 2/1968 | Macaluso | 52/282.2 X |
| 3,507,066 | 4/1970 | Widigs | 40/732 |
| 3,648,393 | 3/1972 | Parrilla | 40/730 |
| 3,774,331 | 11/1973 | Coelho . | |
| 3,811,214 | 5/1974 | Tate . | |
| 3,813,800 | 6/1974 | Turner et al. . | |
| 4,385,459 | 5/1983 | McGrath et al. | 40/605 X |
| 4,726,133 | 2/1988 | Rainone et al. | 40/780 |
| 4,805,326 | 2/1989 | Rainone et al. | 40/780 |
| 4,912,863 | 4/1990 | Harvey . | |
| 4,986,013 | 1/1991 | Pollack | 40/729 X |
| 5,090,145 | 2/1992 | Chiang et al. | 40/605 |
| 5,343,643 | 9/1994 | Cochrane . | |

FOREIGN PATENT DOCUMENTS

| | | | |
|---|---|---|---|
| 2065527 | 10/1992 | Canada | 40/152 |
| 399957 | 11/1990 | European Pat. Off. | 40/605 |
| 2549520 | 1/1985 | France | 52/204.7 |
| 1771677 | 10/1992 | U.S.S.R. | 40/152 |
| 649455 | 1/1951 | United Kingdom | 40/152 |

*Primary Examiner*—Brian K. Green

*Attorney, Agent, or Firm*—Burns, Doane, Swecker & Mathis, L.L.P.; William A. Knoeller

[57] ABSTRACT

A molding for making picture frames having grooves in the molding edges which will form the rear face and the outer periphery of an assembled frame. These grooves may be used to receive plywood panels to make the frame deeper, as in a shadow box, or to make the frame wider. If the grooves are not used they add to the decorative effect of the frame.

1 Claim, 5 Drawing Sheets

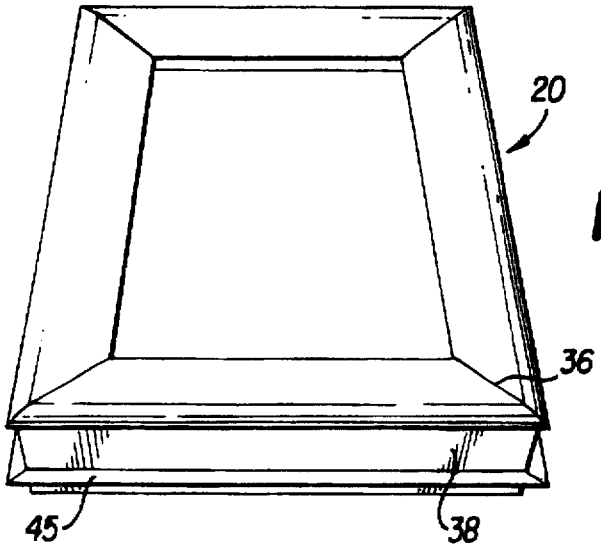
FIG. 3
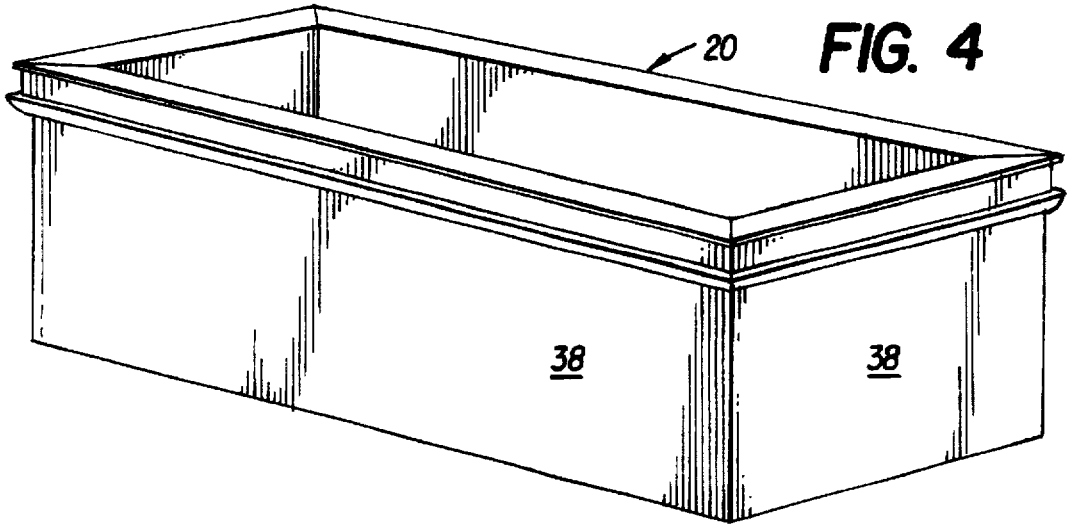
FIG. 4
FIG. 5
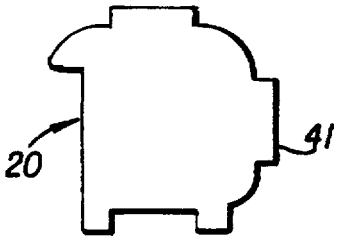
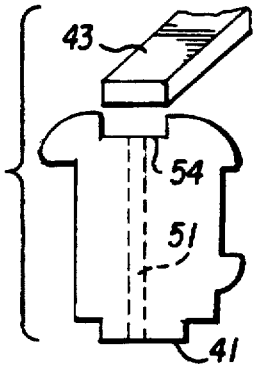
FIG. 6
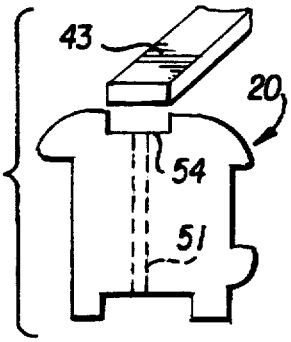
FIG. 7

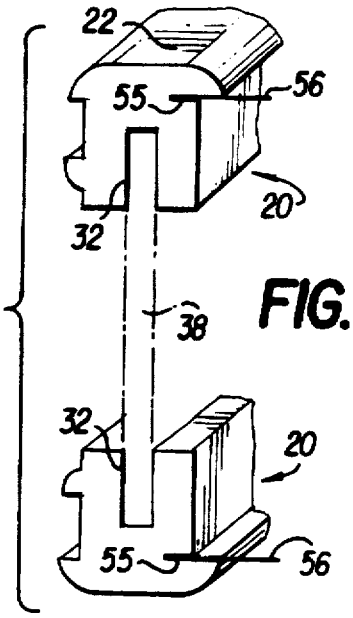
FIG. 20
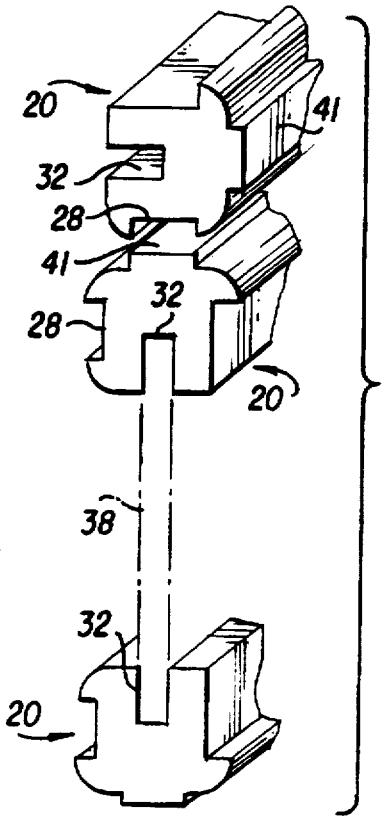
FIG. 21
FIG. 22
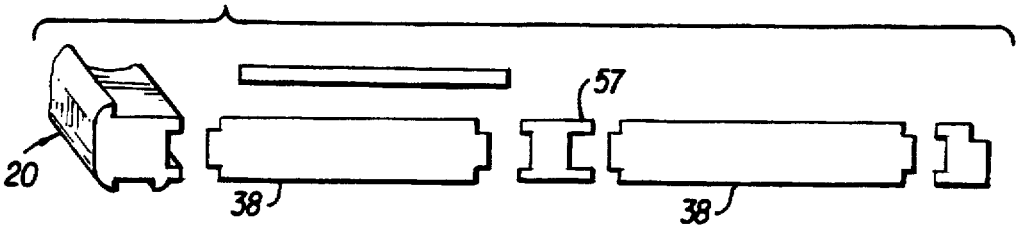
FIG. 23
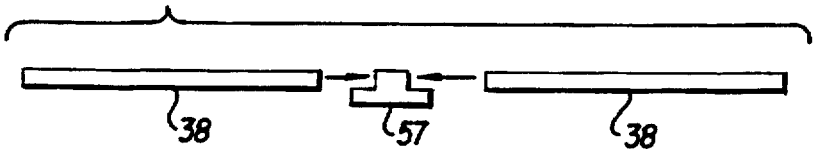
FIG. 24
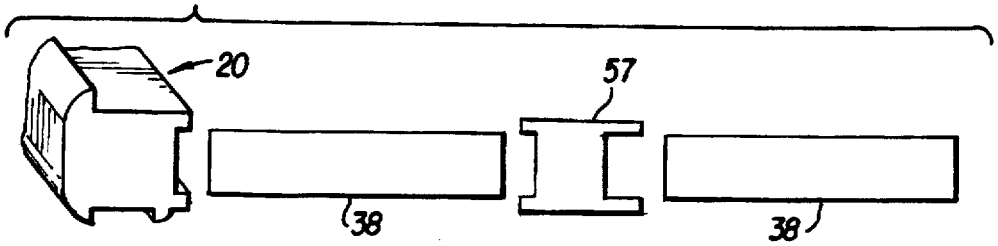

PICTURE FRAME MOLDING

This application is a continuation of application Ser. No. 08/539,751, filed Oct. 5, 1995, now abandoned.

BACKGROUND OF THE INVENTION

It is well known to make picture frames of a molding which is cut into lengths to suit the size of the picture to be framed, with the ends of the cut pieces being cut on a 45° angle so the top, bottom and side members can be fitted together to form a rectangle with beveled corners.

SUMMARY OF THE INVENTION

The present invention relates to picture frame moldings and particularly to a molding which can be used not only for conventional framing but also to form a frame with a greater depth, a so called "shadow box", or to form a frame to which outwardly extending panels can readily be attached so as to form a picture frame of greater than usual width.

The picture frame molding of the present invention has the usual rabbeted-out area on its inner periphery for holding a picture, a backing material behind the picture and, optionally a glass sheet in front of the picture. In addition, the molding of the present invention has a panel-receiving groove on its rear surface and/or on its outer periphery. These panel-receiving grooves serve a decorative function if they are not needed and can readily receive additional panels which can be cut from a rigid sheet material such as plywood. If the additional panels are inserted in rear grooves they serve to make the frame deeper; if additional panels are inserted into the outer peripheral groove they serve to make the frame wider on each side, such as would be used when framing a large picture. If only narrow panels are available, the invention also provides special moldings for joining together two panels to make a deeper shadow box.

Although picture frames are frequently made of wood, it is also contemplated that the frame moldings and panels of the present invention may be other materials such as plastic or metal.

As is well known, a picture framing shop usually carries a large number of different moldings in stock; some being wider or narrower, some being plain and others being ornate. It is a considerable stocking problem to keep all possible moldings in stock.

Thus one object of the present invention is to stock a relatively few "basic" picture moldings which can be readily modified by joining the molding together by "stacking" one molding on the other or by use of accessory panels to convert a basic molding into one of greater depth or greater width or both.

Other objectives and advantages will be apparent upon a review of the attached drawings.

BRIEF DESCRIPTION OF THE DRAWINGS

FIG. 3 is a picture frame formed with a molding as shown in FIGS. 1 and 2 and having additional panels extending rearwardly to form a shadow box;

FIG. 4 is a box having a finishing molding on its upper edge which is formed from the molding depicted in FIGS. 1 and 2;

FIGS. 5–11 are end views of various alternative picture frame moldings;

FIG. 20 is a perspective view of two complementary moldings on opposite edges of an elongate relatively thin panel such as plexiglass;

FIG. 21 is a perspective view similar to FIG. 20 but showing how a similar third molding, rotated 90°, can be used to build a corner;

FIG. 22 is an end view showing two narrow panels with rabbeted edges joined by an H shaped molding;

FIG. 23 is an end view of two narrow panels joined by an inverted T shaped molding; and FIG. 24 is an end view similar to FIG. 21 in which the panels have square-cut rather than rabbeted edges.

In some of the figures, parts which would usually be in contact with each other are shown slightly spaced apart for convenience in illustration.

DETAILED DESCRIPTION OF A PREFERRED EMBODIMENT

Figure 1:
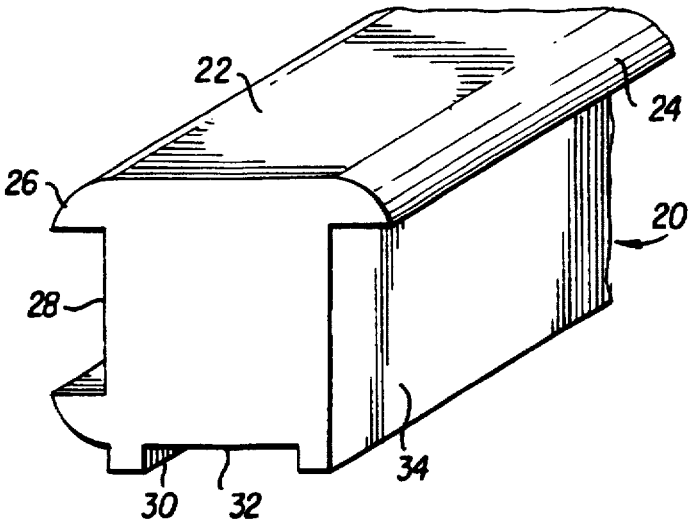
FIG. 1 is a perspective view of a portion of a picture frame molding member, showing the cross-sectional shape thereof.
Figure 13:
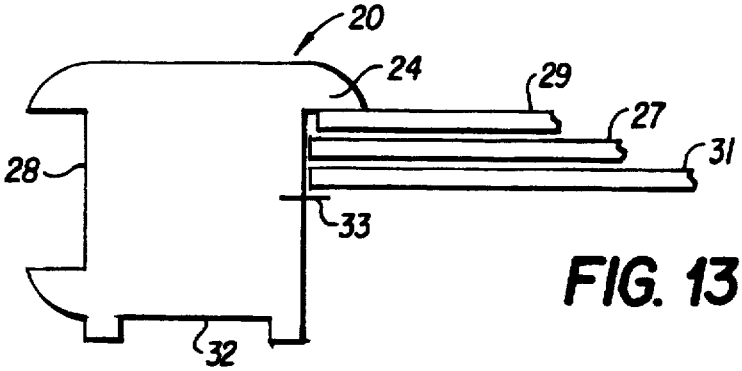
FIG. 13 is an end view of the picture frame molding as shown in FIGS. 1 and 2 and including a picture, cover glass and backing material.

Turning now to FIG. 1, a picture frame molding 20 has a decorative front face 22 which includes a curved portion 24 having an overhanging edge 25 for engaging the outer surface of a picture held in a frame. Alternatively, as shown in FIG. 13, the outer surface of picture 27 may be covered by a glass sheet 29. The rear surface of the picture is usually reinforced by a backing material 31 held in place by small nails or push points 33, (FIG. 13).

As is the usual case the molding is cut into lengths to suit the outside dimensions of the picture being framed, with a 45° miter cut at each end of the cut molding. The miter cuts are then fitted together and secured in any desired manner such as an adhesive and/or nails or screws or other mechanical fasteners. The assembled frame can then be used in the same manner as any usual frame, the picture 27 (or mirror) the backing material 31 and the optional cover glass sheet 29 may be assembled as in FIG. 13. In the construction of FIG. 13 the rear groove 32 and the outer peripheral groove 28 are not used.

Figure 14:
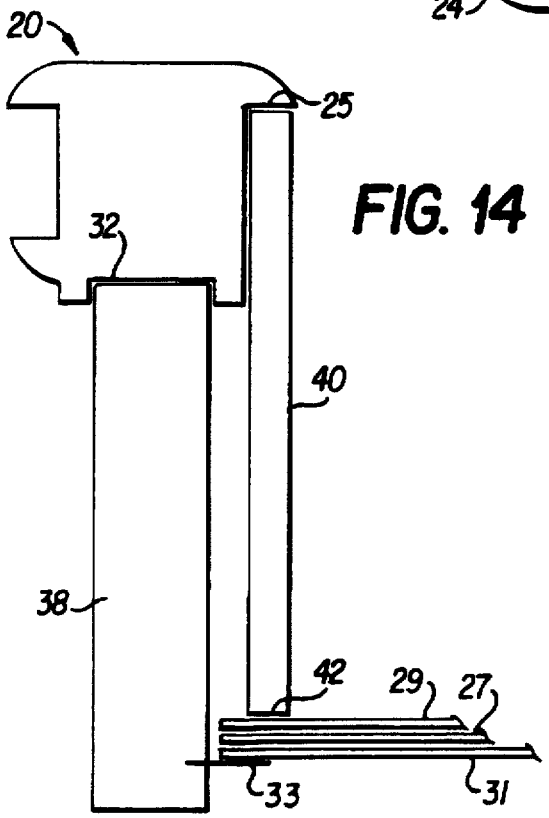
FIG. 14 is an end view showing the molding and picture as in FIG. 13 but with a rearward extension.

Advantageously, the much greater flexibility of the present invention can be brought into play by adding a greater depth to form a shadow box frame as shown in FIG. 14. As illustrated therein the very same molding 20 as in FIG. 13 is used but instead of the picture 27, glass 29 and backing material 31 being mounted as shown in FIG. 13, there is a rear extension panel 38, for example a piece of ½" plywood, adhesively secured in rear groove 32 so as to make the frame say four inches deeper. A filler panel 40, for example a piece of ¼ inch plywood say three inches deep, is fitted in the inner periphery 34 and against the overhanging edge 25. The rear end 42 of the filler panel is thus a surface against which the picture 27, the backing material 31 and the optional glass sheet 29 may be placed and held in position by a small nail or push point 33 in the same manner as in FIG. 13.

Another advantage of the present invention is made clear by a comparison of FIGS. 13 and 14. A picture may be initially framed as in FIG. 13 without any added frame depth. If the owner then decides that the picture would have greater aesthetic appeal in a deeper frame, it is not necessary to entail the expense of a new frame. The owner can instead dismount the picture, glass and backing, add an extension panel 38 and a filler panel 40 to his already properly sized frame, and then proceed to remount the very same picture, glass and backing as were previously used without any additional cutting or fitting; the picture, backing and glass can remain exactly the same size.

Figure 15:
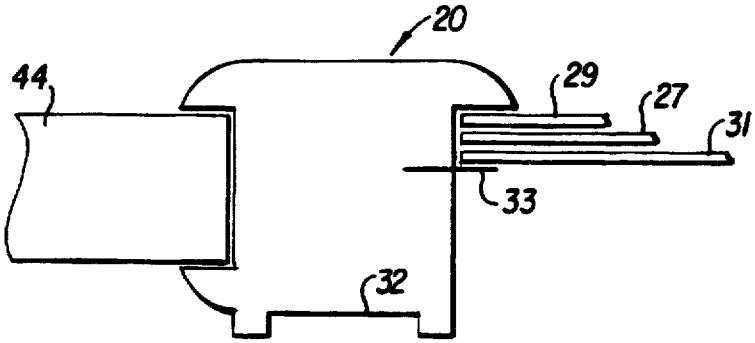
FIG. 15 is an end view showing the molding and picture of FIG. 13 but with an outward frame extension.

FIG. 15 illustrates how an outside panel 44 may be added to an existing framed picture without the necessity of dismounting the picture 27, the glass 29 or backing material 31 from a frame made of the present molding 20. A comparison of FIGS. 13 and 15 shows that the picture mounting is identical; it is only necessary that outer panel 44 be secured in outer peripheral groove 28.

It is to be understood that although outer panel 44 has been shown, for convenience in illustration, as a plain piece of material, for example prefinished ½ inch veneered plywood, that panel 44 could be made of other material and embossed or painted with various decorations so as to offer a large variety of aesthetically pleasing frame widening accessories without the necessity of stocking a similar variety of frame moldings.

FIG. 3 shows a completed frame having rear extension panels 38 on all four sides so as to present a shadow box effect as shown in FIG. 14. Such an extended frame may optionally have an external trim molding 45 to add further decorative effect to the outside of the extension panels 38.

Figure 2:
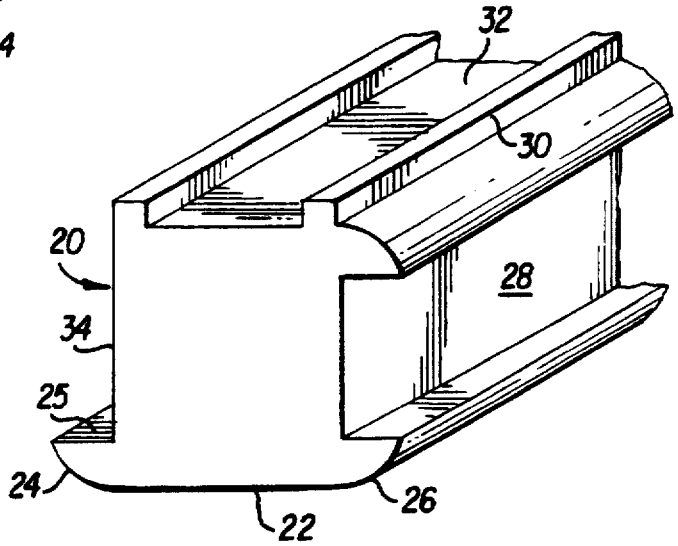
FIG. 2 is a perspective view of the same picture frame molding as shown in FIG. 1 but rotated 180° to show the outer surfaces not shown in FIG. 1.

FIG. 4 shows that a picture molding 20 as illustrated in FIGS. 1 and 2 can also be used as an edge finishing on a deeper frame or container.

FIGS. 5–11 are examples of molding end views which show that the present picture molding 20 may be made in a variety of shapes; these examples are by way of illustration, not limitation. It should be noted that some of the frame shapes have a protuberance 41 rather than a groove 28 or 32 as in FIGS. 1 and 2. These protuberances are of a size and shape so that they will interfit into a groove in order to "stack" molding and give a different visual appearance to a finished picture frame.

Alternatively, if one decides to use a molding shape having a groove 28 or 32 when a protuberance is desired, then a filler strip 43 which is of greater thickness than the depth of the groove can be placed in the groove, thus creating a protuberance.

Figure 12:
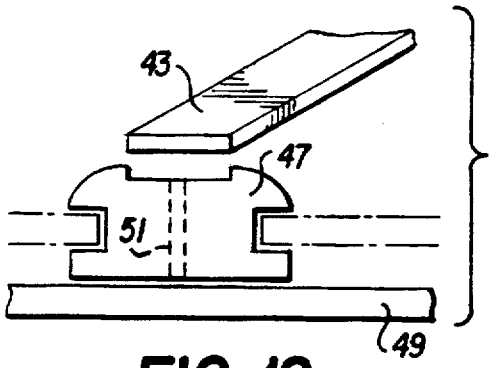
FIG. 12 is an end view of a molding for mounting on a wall so that two or more panel sections may be extended therefrom.

FIG. 12 is an end view of a molding 47 intended for mounting on a wall 49 by means of an adhesive or nails or screws through the central aperture 51 thereof. This molding would be used, for example, in a retail fabric or jewelry store where it would be preferably permanently mounted as part of a display room wall, extending horizontally or vertically or four pieces joined together to form rectangles mounted to project from the wall surface. When it was desired to frame up a special display such as a shadow box, then an appropriately sized rectangle could be used to receive extension panels 38 to form the sidewalls of the desired shadow box. The outer edges of the side walls would then be finished with a suitable molding 20.

In another alternative construction, one of the side grooves could be used to receive a side extension panel to act as display board for a particular piece of merchandise. Preferably all of the groove would be dovetail shaped in cross section so that extension panels could be snapped in and held in position without the need for additional fasteners.

Figure 16:
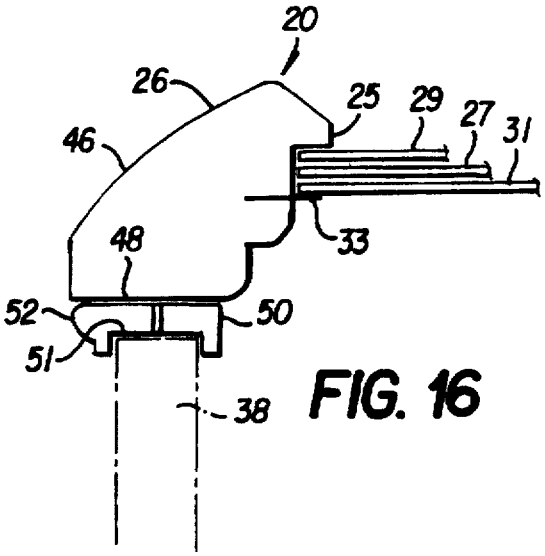
FIG. 16 is an end view of an alternative shaped frame and auxiliary rear molding.
Figure 8:
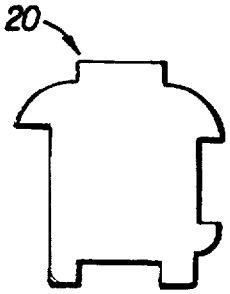

FIG. 16 is an end view of a frame molding which would be cut and assembled into a frame in the same manner as described above. However in this case the molding 20, while having the same overhanging edge 25, does not initially have a rear groove 32, it instead has a planar rear surface 48 to which an auxiliary grooved molding 50 may be attached. The molding 50 has a curved outer face 52 so as to blend aesthetically with the convexly curved face 46 of the molding 20. Molding 50 can be attached turned so the curved side 52 is on the inside of the molding to give the outside appearance of a more boxed straight line effect.

The auxiliary grooved molding 50 has a front planar surface for attachment to the planar rear surface 48 of the frame and has a rear groove 51 which, when attached to a frame, serves the same purpose a rear groove 32 previously described. That is, the rear groove 51 can receive the edge of a rear extension panel 38 and a shadow box can be formed in the same manner as in FIGS. 14.

Figure 17A:
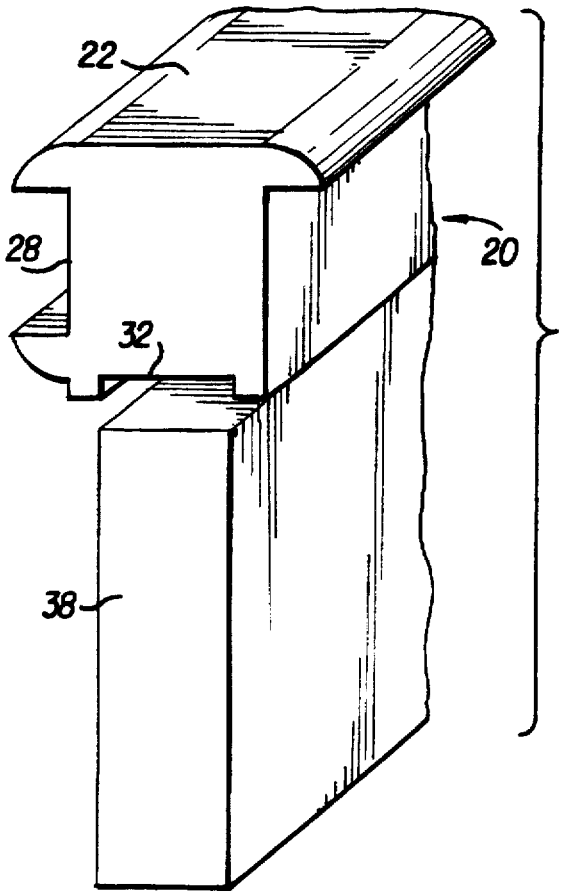
FIG. 17A is a perspective view of a molding similar to FIG. 14.
Figure 17B:
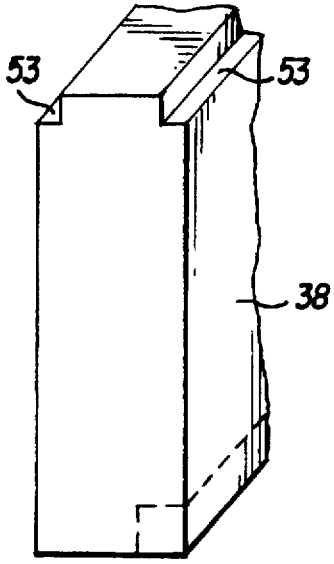
FIG. 17B is a perspective view of an alternative panel, similar to the panel of FIG. 17A.

A comparison of FIGS. 17A and 17B will show that the rear extension panel 38 may have a square cut end as in FIG. 17A or rabbeted out an shown by numeral 53. it so rabbeted the rear extension panel 36 can be fitted into the molding 20 so that the finished frame looks like one solid frame) the extension panel 38 blends into the molding 20. On the other hand if a noticeable line of joining is aesthetically desired, then the square cut panel 38 as shown in FIG. 17A would be used.

It is to be understood that the rear extension panels 38 may be of a translucent material or a transparent material such as plexiglass. If plexiglass is used the rear groove 32 would preferably be narrower but deeper so that the plexiglass can be adhesively secured therein.

Figure 9:
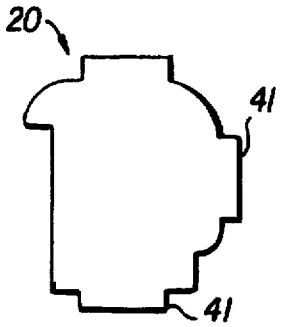
Figure 10:
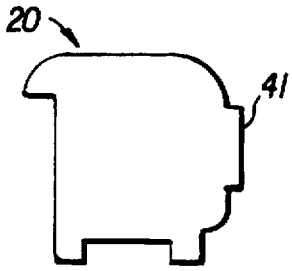
Figure 11:
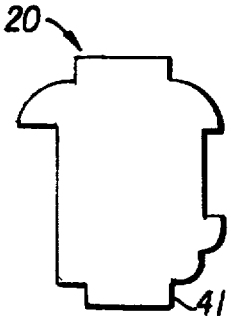
Figure 18:
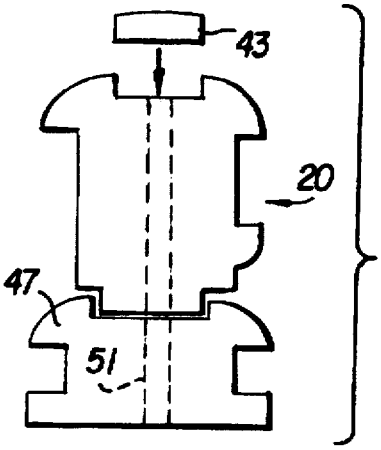
FIG. 18 is an end view showing the molding of FIGS. 6 and 12 joined together.

FIG. 18 shows a stacking of a wall molding 47 and a picture molding 20. When such a stacking is done it is preferable to use a molding with a rear protuberance such as shown in FIGS. 6, 9 or 11. Alternatively, if a molding 20 with a rear groove such as in FIGS. 5, 7, 8 or 10 is used, then a filler strip 43, having a thickness almost as great as the depth of the mating grooves would be used and the central apertures 51 would be aligned or specially drilled so as to be in alignment.

Figure 19:
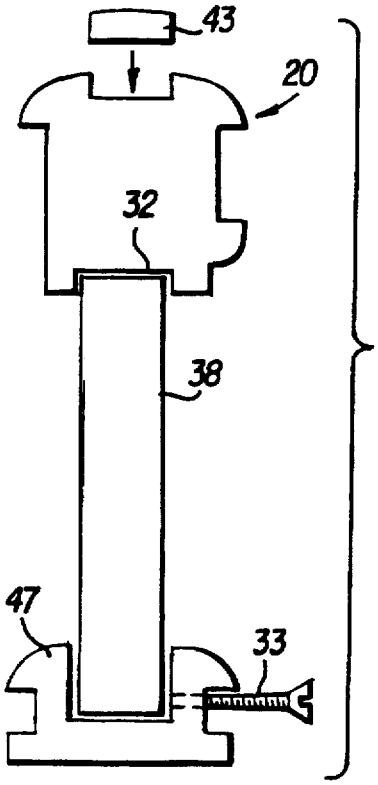
FIG. 19 is an end view showing the moldings of FIGS. 7 and 12 used together with an intermediate panel.

FIG. 19 shows the assembly of a wall molding 47, a rear extension panel 38 and a picture molding 20 for a deep wall mount. If the molding 20 is one which has a front groove 54 then, for decorative effect it can be covered with a filler strip 43, preferably one with a rounded outer surface as shown in FIG. 19. The panel 38 is secured in the groove of wall molding 47 by means of adhesive and/or a small nail or screw 33.

FIG. 20 shows two similar picture moldings 20 which are turned so that the rear grooves 32 face each other. A transparent plexiglass rear extension panel 38 is secured in each groove 32 preferably by means of an adhesive. In this case the grooves 32 are narrower and deeper than the grooves shown in other figures, for example FIG. 14. The moldings 20 of FIG. 20 also have a narrow side groove 55 to receive a further sheet of plexiglass 56. Thus the molding 20, when used as shown in FIG. 20 can be used as a corner piece between two panels; by use of four such moldings, one on each corner, a square can be built; by proper selection of moldings and panels a cube or closed box can be constructed.

FIG. 21 is similar to FIG. 20 in that its construction uses two similar picture moldings 20 but in FIG. 21 the moldings are different in two respects: they do not have side grooves 55 and do have protuberances 41 on the outer face of the molding. Thus the upper molding of FIG. 21 may be rotated by 90° so that its outer peripheral groove 28 is aligned with and complementary to protuberance 41 which can be snugly fitted and secured therein by adhesive or mechanical fastening means such as nails or screws. Thus the moldings of FIG. 21 may also be used to form a corner between two adjacent panels such as ¼" plexiglass or plywood. With such an assembly a rectangular frame can be built and by proper selection of moldings and panels a cube or closed box can be constructed.

FIGS. 22–24 show various joining moldings 57 for use in joining or splicing together two rear extensions panels 38. As a matter of convenience in stocking materials or because a shop keeper does not have equipment to cut wide panels 38, it is likely that a frame shop would only have available rear extension panels 38 of say a 4 inch width. When a customer wants a shadow box or other frame of a deeper dimension, two panels 38 can be joined together by means of joining moldings 57. In FIG. 22 the two panels 38 have rabbeted out corners so that, when joined, and interfitted with the "H" shaped molding 57 a smooth join will be presented.

The arrangement of FIG. 23 with a "T" shaped joining molding 57 is especially useful for joining relatively thin panels 38 such as ¼ plywood or plexiglass where it would be difficult to rabbet out the edges as was done in FIG. 22.

In FIG. 24 the panels 38 have square cut edges (similar to the panel in FIG. 17A) and the "H" shaped joining molding will be visible on each side of the joined panel for decorative effect where appropriate.

I claim:

1. A rectangular picture frame assembly comprising:

a first frame including four moldings assembled together;

a second frame including four moldings assembled together;

each of said moldings of said first and second frames having the same shape;

each of said moldings of said first and second frames having an elongated body of poly-sided cross section with a decorative front face, an opposed rear face, an outer side face, and an inner face;

each said inner side face having an inwardly facing projecting lip for engaging and holding in place an outer surface of a picture or a piece of glass within said frame;

said rear face of each of said four moldings of said first and second frames having a substantially continuous groove therein; and four planar sheets, said planar sheets received within respective grooves of said first and second frames, said planar sheets connecting said first frame to said second frame.

* * * * *